US009186563B2

(12) United States Patent
Burger

(10) Patent No.: US 9,186,563 B2
(45) Date of Patent: Nov. 17, 2015

(54) TAMPER-RESISTANT BALL BAT

(71) Applicant: George Burger, Rocklin, CA (US)

(72) Inventor: George Burger, Rocklin, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 213 days.

(21) Appl. No.: 13/861,345

(22) Filed: Apr. 11, 2013

(65) Prior Publication Data

US 2013/0316859 A1 Nov. 28, 2013

Related U.S. Application Data

(60) Provisional application No. 61/622,652, filed on Apr. 11, 2012.

(51) Int. Cl.
*A63B 59/06* (2006.01)

(52) U.S. Cl.
CPC ..... *A63B 59/06* (2013.01); *A63B 2209/023* (2013.01); *A63B 2225/72* (2013.01)

(58) Field of Classification Search
CPC ..... A63B 59/06; A63B 2209/02; A63B 2209/023
USPC ..... 473/457, 564–568, 519, 520
See application file for complete search history.

(56) References Cited

U.S. PATENT DOCUMENTS

| | | | | |
|---|---|---|---|---|
| 2,379,006 | A * | 6/1945 | Johnson | 473/568 |
| 4,600,193 | A * | 7/1986 | Merritt | 473/566 |
| 4,931,247 | A * | 6/1990 | Yeh | 264/258 |
| 5,114,144 | A * | 5/1992 | Baum | 473/567 |
| 6,344,007 | B1 * | 2/2002 | Feeney et al. | 473/567 |
| 6,761,653 | B1 * | 7/2004 | Higginbotham et al. | 473/566 |
| 7,214,152 | B1 * | 5/2007 | Vacek et al. | 473/566 |
| 7,874,946 | B2 * | 1/2011 | Smith | 473/567 |
| 7,914,404 | B2 * | 3/2011 | Giannetti et al. | 473/566 |
| 8,152,662 | B2 * | 4/2012 | Dill | 473/564 |
| 8,512,176 | B1 * | 8/2013 | Mathew et al. | 473/567 |
| 8,602,924 | B2 * | 12/2013 | Shindome et al. | 473/566 |
| 8,852,037 | B2 * | 10/2014 | Epling et al. | 473/567 |
| 2004/0198539 | A1 * | 10/2004 | Sutherland et al. | 473/567 |
| 2009/0174114 | A1 * | 7/2009 | Chen | 264/263 |
| 2009/0181813 | A1 * | 7/2009 | Giannetti et al. | 473/567 |

* cited by examiner

*Primary Examiner* — Mark Graham
(74) *Attorney, Agent, or Firm* — Bingham Greenebaum Doll LLP

(57) ABSTRACT

A tamper-resistant ball bat may include a barrel having a tamper-resistant layer and a handle coupled to the barrel. The tamper-resistant layer may include a plurality of composite strips. The composite strips may be layered such that each composite strip radiates outward from the longitudinal axis of the barrel. Each composite strip may include a plurality of longitudinal edges. The longitudinal edges may be disposed at an angle with respect to the longitudinal axis of the barrel.

17 Claims, 5 Drawing Sheets

TAMPER-RESISTANT BALL BAT

CROSS-REFERENCE TO RELATED APPLICATION

This application claims the priority benefit of U.S. provisional patent application No. 61/622,652, filed on Apr. 11, 2012, the disclosure of which is incorporated by reference herein.

BACKGROUND

The present disclosure relates to ball bats. More particularly, the present disclosure relates to tamper-resistant ball bats. In recent years, composite ball bats have become extremely popular within collegiate-level baseball leagues, men's and women's softball leagues, and related youth leagues. Unlike traditional ball bats featuring solid body constructions made from wood or aluminum, composite ball bats are made from lightweight fibers. As a result, they are much lighter than traditional ball bats and allow a player to achieve an increased bat speed when swinging at a pitch.

Although previously offered composite ball bats have successfully delivered increased power-to-weight ratios, they are highly susceptible to tampering or "doctoring." Tampering with a composite ball bat commonly entails squeezing the barrel by rolling it between two rollers. In doing so, a player can apply sheer forces that are high enough to delaminate the composite layers. Delamination occurs when the shear stress between composite layers exceeds the strength of the matrix resin. When the internal layers of a composite ball bat delaminate, the bat becomes less stiff and the internal layers take on trampoline-like properties. Increased trampoline-like properties ultimately result in a player being able to hit a ball with greater force.

With previously offered composite bats, delaminations generally occur at or near the center of the layup thickness where the shearing stresses peak. They then propagate along the fibers in such a way that they remain hidden below the surface of the bat. Because internal delaminations do not show any visible damage to the surface of a bat, it is easy for players to secretly tamper with previously offered composite bats. Rampant cheating amongst ball players at any skill level damages the integrity of the sport and can leave lasting negative impressions on participants. The sports industry needs an improved composite bat that is less vulnerable to concealable tampering.

BRIEF DESCRIPTION

In an embodiment, a tamper-resistant ball bat may include a barrel having a tamper-resistant layer and a handle coupled to the barrel. The tamper-resistant layer may include a plurality of composite strips. The composite strips may be layered such that each composite strip radiates outward from the longitudinal axis of the barrel. Each composite strip may include a plurality of longitudinal edges. The longitudinal edges may be disposed at an angle with respect to the longitudinal axis of the barrel.

DETAILED DESCRIPTION

Those of ordinary skill in the art will realize that the embodiments of a tamper-resistant ball bat described herein are merely illustrative and are in no way exhaustive or otherwise limiting. Additional embodiments will readily suggest themselves to such skilled persons after reviewing the present disclosure.

Figure 1A:
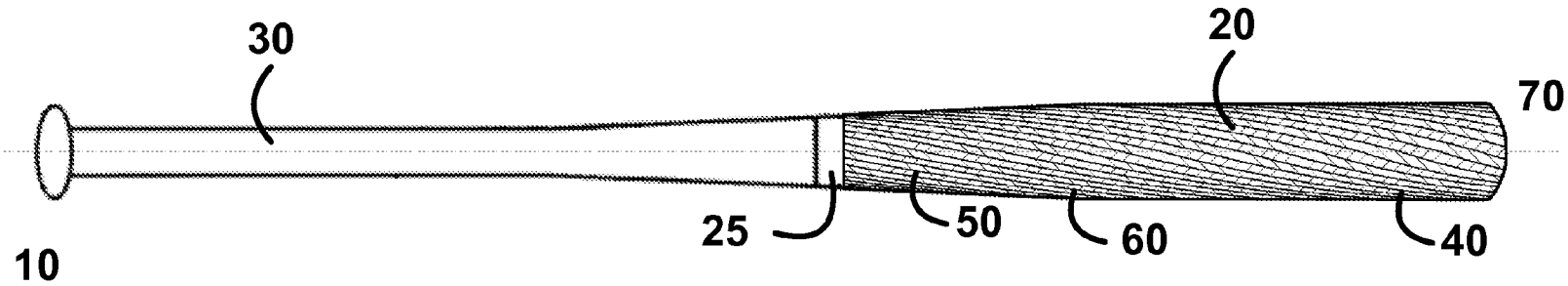
FIG. 1A is a side view of an exemplary tamper-resistant ball bat.
Figure 1B:
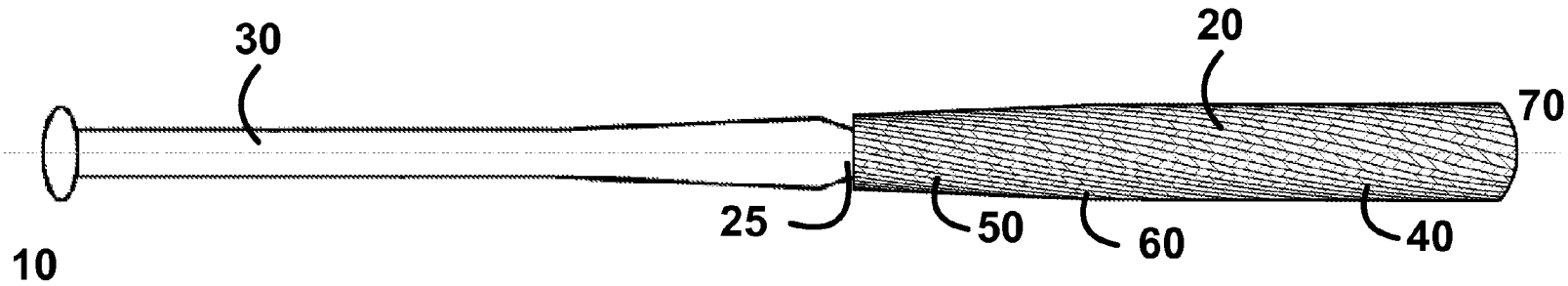
FIG. 1B is a side view of another exemplary tamper-resistant ball bat.

As shown in FIGS. 1A and 1B, embodiments of a tamper-resistant ball bat 10 may include a barrel 20 and a handle 30. Handle 30 may be coupled to barrel 20. In some embodiments, handle 30 may be coupled to barrel 20 through a coupling region 25. Handle 30 may be coupled to barrel 20 using know methods such as a socket, as shown for example in U.S. Pat. No. 8,226,505 issued to Burger. In some embodiments, coupling region 25 may include an enclosed socket, as shown in FIG. 1A, while in other embodiments coupling region 25 may include an exposed socket, as shown in FIG. 1B. Coupling region 25 of FIG. 1A depicts the socket of FIG. 1B except that the socket of FIG. 1A has been enclosed with wrapped and cured composite material. In still other embodiments, coupling region 25 may include other suitable coupling mechanisms known in the art, such as a scarf joint (not shown) or other similar joints employed in the manufacture of solid body bats. In such cases, barrel 20 and handle 30 may remain coupled via pressure while maintaining a substantially consistent wall thickness throughout the length of bat 10.

Figure 2:
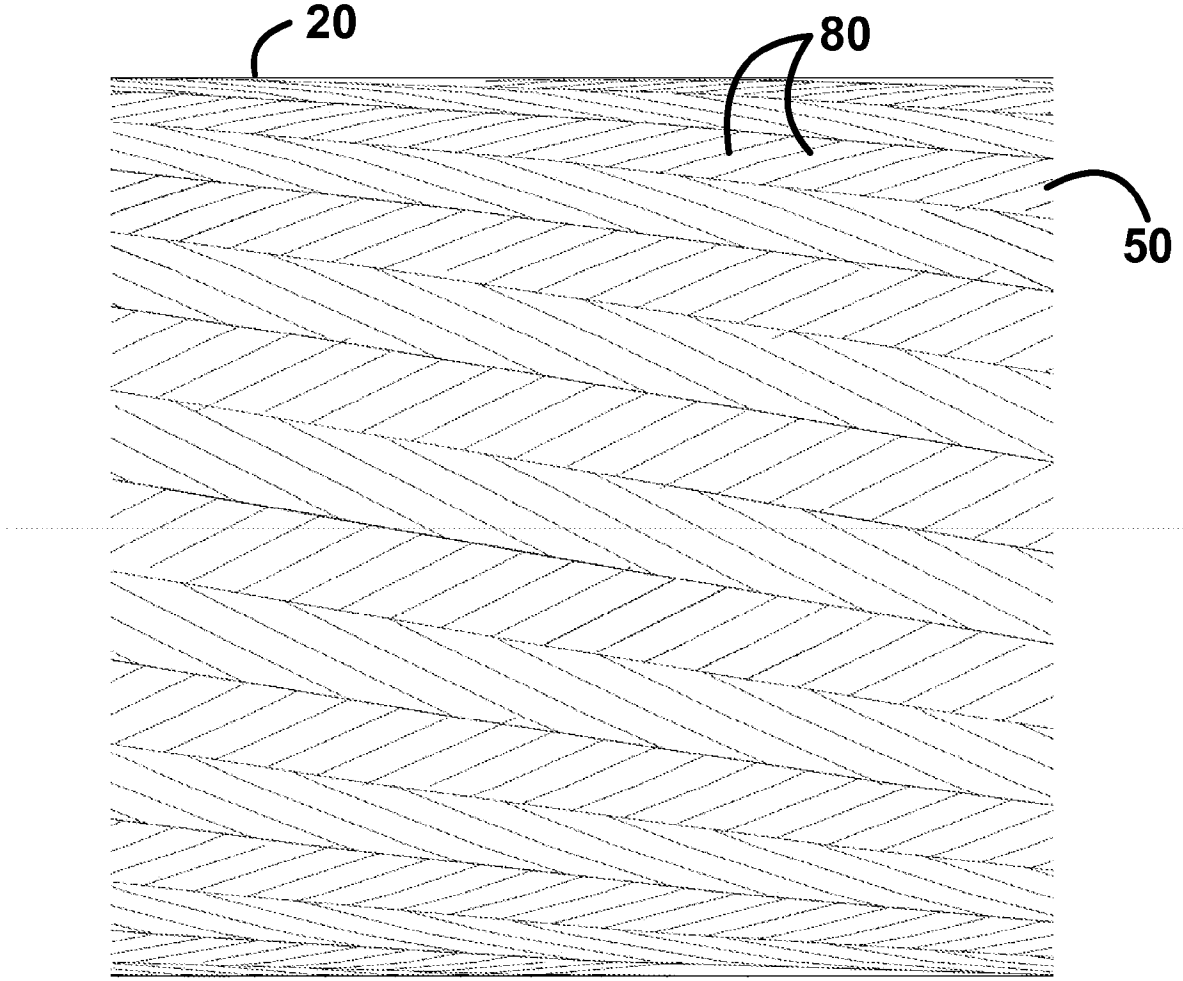
FIG. 2 is a close-up view of an exemplary tamper-resistant ball bat.

Barrel 20 may include a tamper-resistant layer 40, which may include a plurality of composite strips 50 (shown in detail in FIG. 2). Composite strips 50 may include or be made from any suitable composite material, such as graphite fabric pre-impregnated with epoxy resin ("pre-preg"). In embodiments utilizing pre-preg, the pre-preg may be "hot melt" pre-preg, "dip coat" pre-preg, or any other suitable form of pre-preg. Composite strips 50 may be semi-cured such that they are semi-adhesive or "tacky" prior to being fully cured. In some embodiments, composite strips may be uniform in width.

Composite strips 50 may be disposed such that they are layered by partially overlapping composite strips 50 with respect to the longitudinal edges 60 of each composite strip 50. In some embodiments, composite strips 50 may be layered with a uniform spacing between the respective longitudinal edges 60 of the top and bottom composite strips 50. Composite strips 50 may be layered such that each composite strip 50 radiates outward from the longitudinal axis 70 of barrel 20 toward the outermost surface of bat 10. When layered in such a fashion, composite strips 50 may resemble the flaps of a flapper wheel. In such cases, because composite strips 50 radiate outward from longitudinal axis 70, any delaminations that occur beneath the outermost surface of bat 10 as a result of tampering naturally propagate outward until they are eventually revealed on the outermost surface.

In some embodiments, composite strips 50 may be disposed in a plurality of groups. Each group of composite strips 50 may include sufficient composite strips 50 to form the entire perimeter of barrel 20 when disposed in the layered fashion described above. Each group may then partially overlap an adjacent group of composite strips 50 disposed nearer to coupling region 25. The groups of composite strips 50 may overlap one another with respect to the latitudinal edges (not shown) of the composite strips 50 of each group. By grouping composite strips 50 and layering them with respect to the latitudinal edges of the composite strips 50 of each group, more composite strips 50 may extend from the innermost surface of barrel 20 to the outermost surface of barrel 20 than in other embodiments in which a single group of composite strips 50 runs the entire longitudinal length of barrel 20. Such embodiments may provide for even further enhanced sensitivity when detecting attempts to tamper or doctor tamper-resistant bat 10.

Figure 5:
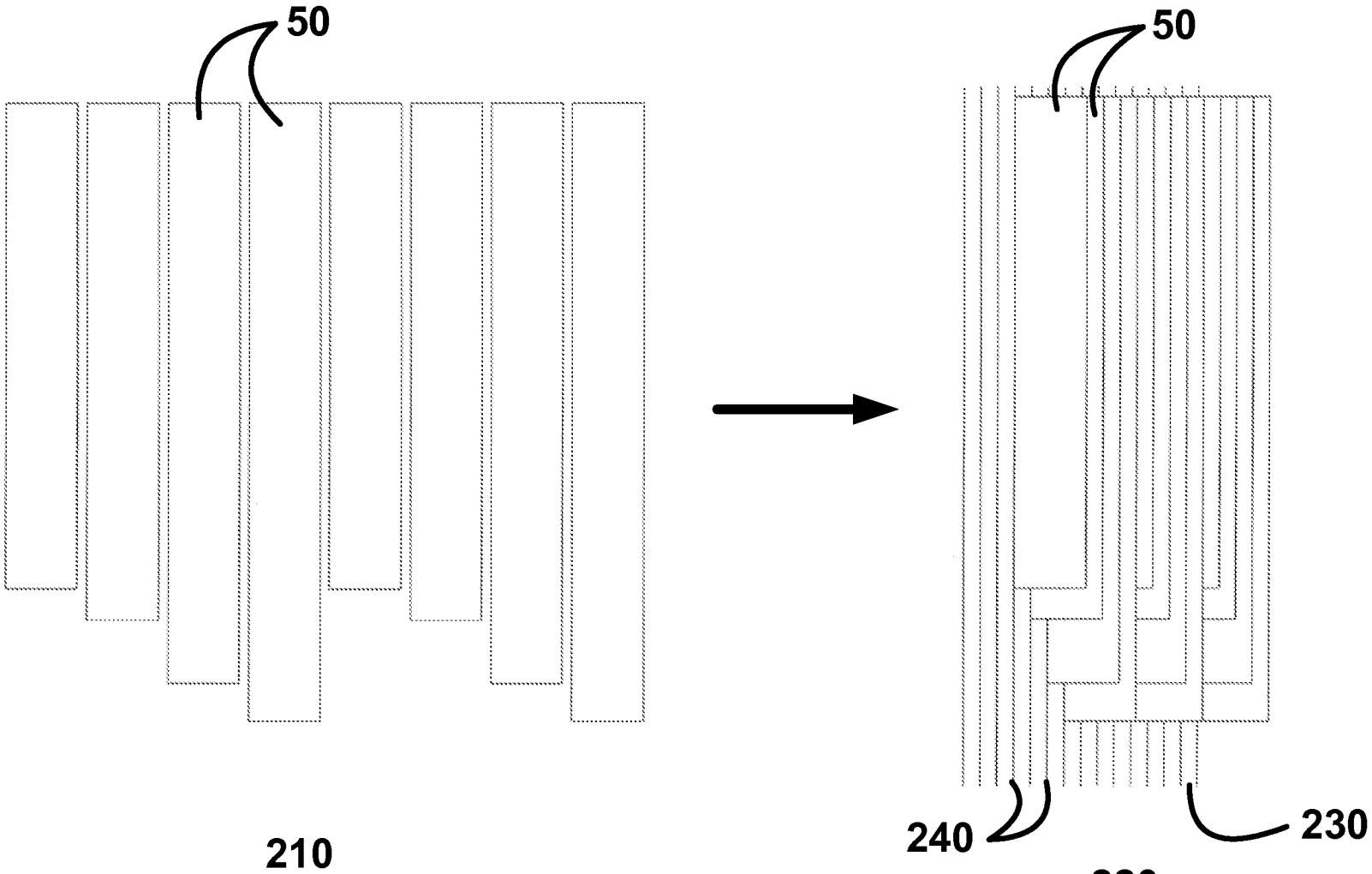
FIG. 5 is a top view of an exemplary lay-up for manufacturing an exemplary tamper-resistant ball bat.

In some embodiments, each group may include composite strips 50 of varying lengths (as shown in the exemplary group of FIG. 5). In such embodiments, the groups closer to coupling region 25 may include increasingly shorter composite strips 50 to account for the reduction in the diameter of barrel 20 as barrel 20 tapers down into coupling region 25. By removing the layering of composite strips 50 from some regions, such embodiments allow bat 10 to maintain a substantially constant wall thickness along its entire longitudinal length. The optimum location of shorter composite strips 50 will depend on various design considerations, such as the desired wall thickness of the finished product, material selections, the overall desired diameter and length of bat 10, and the type of coupling region 25 being utilized.

The longitudinal edges 60 of composite strips 50 may be disposed at an angle with respect to the longitudinal axis 70 of barrel 20 such that composite strips 50 spiral around the perimeter of barrel 20. As used herein, the phrase "spiral around" does not require that a composite strip 50 completely traverse the perimeter of barrel 20. Rather, the phrase "spiral around" includes partial or even slight spiraling. In embodiments in which longitudinal edges 60 of composite strips 50 are disposed at an angle with respect to longitudinal axis 70, tamper-resistant ball bat 10 is less prone to premature delaminations that may result from ordinary use because longitudinal edges 60 avoid running parallel to the highest stress direction within bat 10 (i.e., along longitudinal axis 70). Where applicable, the angled nature of composite strips 50 also allows tamper-resistant bat 10 to be more efficiently manufactured because composite strips 50 may be rolled around a mandrel more easily.

FIG. 2 shows a close-up view of an exemplary tamper-resistant layer 40. In some embodiments, each composite strip 50 may include a plurality of fibers 80. In some embodiments, composite strip 50 may include a plurality of plies layered directly on top of one another, each of which may be comprised of fibers 80. Fibers 80 may be disposed at an angle with respect to longitudinal axis 70 of barrel 20. In some embodiments, fibers 80 of each composite strip 50 may be disposed at a different angle with respect to the longitudinal axis 70 of barrel 20 than the angle of fibers 80 of one or more neighboring composite strips 50. In some embodiments, the angle at which fibers 80 of neighboring composite strips 50 are disposed with respect to longitudinal axis 70 of barrel 20 may alternate plus/minus angles.

In embodiments in which composite strips 50 include layered plies, fibers 80 of each ply may be disposed at a different angle with respect to longitudinal axis 70 of barrel 20 than fibers 80 of one or more other plies in that particular composite strip 50. For example, in some embodiments, a composite strip 50 may include two plies layered directly on top of one another. The top ply may include fibers 80 disposed at +47 degree angle with respect to longitudinal axis 70 of barrel 20, while the bottom ply may be disposed at a −37 degree angle with respect to the longitudinal axis 70 of barrel 20. In such embodiments, the fact that fibers 80 are disposed at plus/minus angles with respect to longitudinal axis 70 of barrel 20 helps to make tamper-resistant bat 10 more rigid. In some embodiments, the plus/minus angles may be offset such that the overall angle of composite strip 50 with respect to longitudinal axis 70 of barrel 20 may obtain a particular angle.

In one exemplary embodiment, the diameter of barrel 20 may be about 2.62 inches. In such an embodiment, tamper-resistant layer 40 may include between 50 and 60 composite strips 50. Composite strips 50 may be about 2 inches wide and may feature an offset of about 0.13 inches. The plus/minus angles at which composite strips 50 are disposed with respect to longitudinal axis 70 of barrel 20 may be between about 5 degrees and about 20 degrees. The angle at which fibers 80 of each composite strip 50 are disposed with respect to longitudinal axis 70 of barrel 20 may be between about 25 degrees and about 50 degrees.

The quantity and dimensions of the components discussed herein are provided for illustrative purposes only and are not intended to limit the scope of this disclosure or any related claims. After reviewing the present disclosure, persons or ordinary skill in the art will readily recognize that other quantities and dimensions of the exemplary components discussed herein may be utilized in various additional embodiments of a tamper-resistant bat. For example, in other embodiments, the diameter of barrel 20, the quantity or measurement of composite strips 50, the angle and offset of composite strips 50, and the angle of fibers 80 within each composite strip 50 may be smaller or larger than the exemplary embodiments disclosed herein depending on various design considerations, such as the materials selected, cost considerations, and the intended use (e.g., softball versus baseball).

Figure 3B:
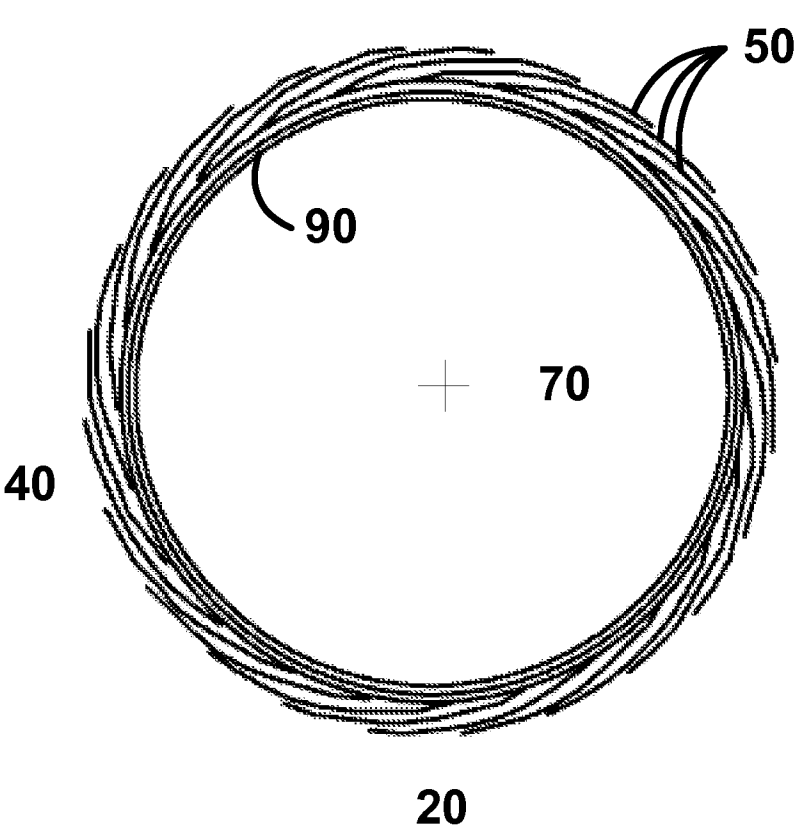
FIG. 3B is a cross-sectional view of another exemplary tamper-resistant ball bat.
Figure 3A:
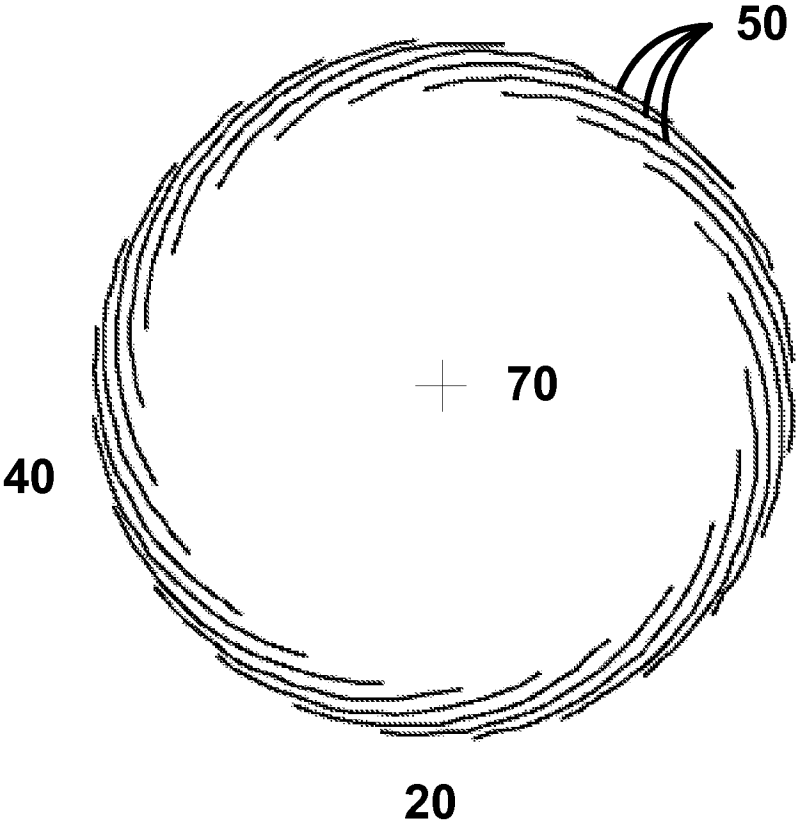
FIG. 3A is a cross-sectional view of an exemplary tamper-resistant ball bat.

FIGS. 3A and 3B show cross-sectional views of two exemplary barrels 20. As shown in FIG. 3A, composite strips 50 of tamper-resistant layer 40 may be layered and disposed such that they radiate outward from longitudinal axis 70 and spiral around barrel 20. When disposed in such a manner, delaminations that occur beneath the outer surface of bat 10 propagate outwards until they reach the outermost surface of bat 10, at which point they are no longer concealed from view. Accordingly, with embodiments of the tamper-resistant bat disclosed herein, delaminations that might ordinarily increase the trampoline effect or "pop" of a ball bat while simultaneously remaining hidden beneath the surface of the bat instead become apparent as a visible sign of potential tampering or "doctoring." Moreover, in some embodiments, the layered nature of tamper-resistant layer 40 may cause barrel 20 to lose its structural integrity altogether when a player attempts to tamper with it. Accordingly, in such embodiments, barrel 20 may actually break or shatter a short while after a player begins attempting to use the tampered bat to hit pitches. With any such embodiments, the probability that a player will successfully get away with cheating by doctoring a bat is substantially reduced.

In some embodiments, such as the exemplary embodiment shown in FIG. 3B, tamper-resistant ball bat 10 may include a supplemental inner layer 90 disposed beneath tamper-resistant layer 40. In several embodiments, supplemental inner layer 90 may include a plurality of plies of pre-preg. For example, in one embodiment, supplemental inner layer 90 may be formed from four plies of 120 gram pre-preg. Supplemental inner layer 90 may include a plurality of fibers (not shown) disposed at plus/minus angles with respect to longitudinal axis 70 of barrel 20. Depending on various design considerations, the plus/minus angles at which the fibers of supplemental inner layer 90 are disposed with respect to longitudinal axis 70 of barrel 20 may be between about 25 degrees and about 50 degrees.

In some embodiments, temper-resistant ball bat 10 may also include a supplemental outer layer (not shown) disposed above tamper-resistant layer 40. In several embodiments, the supplemental outer layer may include a plurality of plies of pre-preg. For example, in one embodiment, the supplemental outer layer may be formed from four plies of 120 gram pre-preg. The supplemental outer layer may include a plurality of fibers (not shown) disposed at plus/minus angles with respect to longitudinal axis 70 of barrel 20. Depending on various design considerations, the plus/minus angles at which the fibers of the supplemental inner layer are disposed with respect to longitudinal axis 70 of barrel 20 may be between about 25 degrees and about 50 degrees.

The optimal angles at which the various exemplary composite layers discussed above may be wrapped to form barrel 20 will depend on various design considerations, including the materials selected, cost considerations, and the intended use (e.g., collegiate baseball, youth or senior league baseball, slow-pitch softball, fast-pitch softball, and many other games). For example, in youth leagues in which safety is a larger concern than performance, the composite layers may be disposed such that the bat features less natural trampoline effect or "pop" than bats used by collegiate-level ball players.

Referring back to FIG. 1, handle 30 may include a plurality of composite layers (not shown). The composite layers may include a plurality of fibers that are disposed at plus/minus angles with respect to longitudinal axis 70 of barrel 20. In various embodiments, the plus/minus angles at which the fibers are disposed with respect to longitudinal axis 70 of barrel 20 may be between about 12 degrees and about 20 degrees. As noted above, the fact that the fibers are disposed at plus/minus angles with respect to longitudinal axis 70 of barrel 20 helps to make tamper-resistant ball bat 10 more rigid. In some embodiments, various layers, such as composite strips 50, supplemental inner layer 90, or supplemental outer layer 100, may be gradually reduced as the layers approach the terminating end of handle 30. Tamper-resistant ball bat 10 may also include one or more composite strips 50 wrapped around coupling region 25 at 90 degree angles with respect to longitudinal axis 70.

Figure 4:
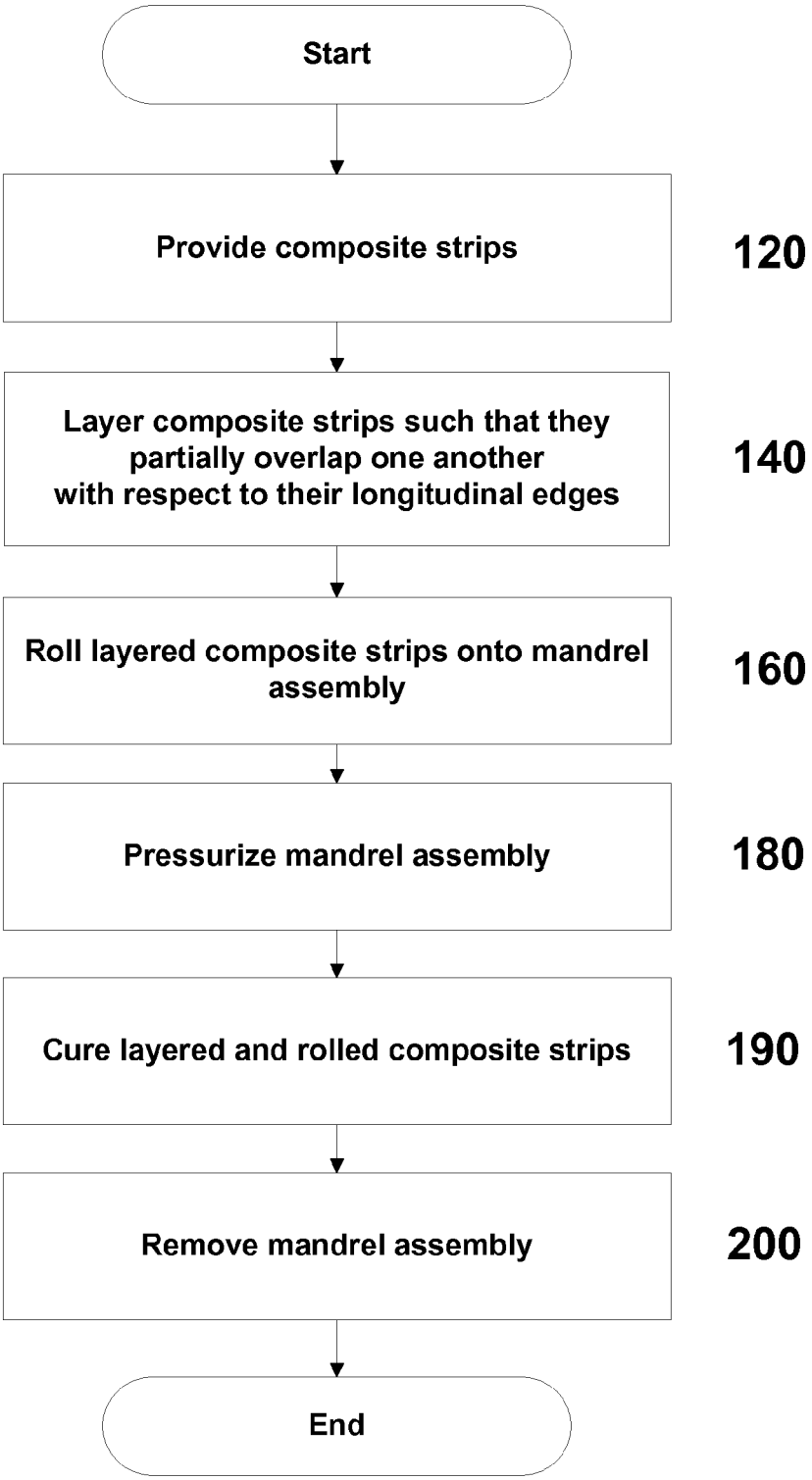
FIG. 4 is a flow diagram of an exemplary method for manufacturing an exemplary tamper-resistant layer.

Some embodiments of the tamper-resistant ball bat disclosed herein may be conveniently manufactured using existing bat manufacturing techniques, such as those described in U.S. Pat. No. 4,923,541 issued to Burger. Other embodiments, such as those including layered groups of composite strips 50, may be manufactured according to the exemplary method shown in FIG. 4. At step 120, a plurality of composite strips may be provided. For example, composite strips 50 may be cut from a sheet of composite material. Composite strips 50 may come semi-cured so that they are semi-adhesive or "tacky" prior to being fully cured. At step 140, composite strips 50 may be "laid up" on a board with notches or marks to achieve proper layering spacing. In doing so, composite strips 50 may be laid up such that they are layered with respect to the longitudinal edges 60 of each composite strip 50.

At step 160, composite strips 50 may be rolled onto a mandrel assembly either manually or in an automated fashion, such through the use of an automated conveyer belt. As composite strips 50 are rolled onto the mandrel assembly, they may also be forced to taper using a tapered mandrel. At step 180, the mandrel assembly may be pressurized. For example, in some exemplary embodiments, a bladder may be placed into the mandrel assembly and the mandrel assembly may be placed into a mold, such as a clam shell mold. The assembly may then be pressurized. At step 190, the layered and rolled composite strips 50 disposed around the mandrel assembly may be cured using heat or any other suitable curing method. For example, in one embodiment, the assembly may be pressurized to about 200 PSI and heated for about an hour at 300 degrees Fahrenheit. Depending on the various design considerations, other pressures, times, and temperatures may prove optimal for manufacturing various embodiments of the tamper-resistant bat disclosed herein. After having been cured, the layered and rolled composite strips 50 may be removed from the mandrel assembly at step 200.

FIG. 5 shows a top view of an exemplary lay-up featuring a group 210 of composite strips 50 in an embodiment in which groups of composite strips 50 are utilized. As noted above, composite strips 50 may be "laid up" on a surface 230 that includes notches or marks 240. Notches or marks 240 may assist a user in achieving proper layering spacing. Composite strips 50 may be laid up such that they are layered with respect to the longitudinal edges 60 of each composite strip 50 to form a layered group 220. Although not shown, multiple groups 220 may also be layered with respect to the latitudinal edges 60 of the composite strips 50 of each group. As noted above, composite strips 50 may feature different lengths so that shorter composite strips 50 may be increasingly employed as the longitudinal length of barrel 20 approaches coupling region 25. In such embodiments, the reduction in layers of composite strips 50 accounts for the reduction in diameter of barrel 20 as barrel 20 tapers down to meet coupling region 25. Such embodiments may feature a substantially constant wall thickness along the entire length of tamper-resistant bat 10.

While illustrative embodiments have been disclosed herein, persons of ordinary skill in the art will realize that other embodiments employing the inventive principles disclosed herein are possible, and such embodiments will readily suggest themselves to such skilled persons. Accordingly, the present disclosure should only be limited within the spirit of the claims.

What is claimed is:

1. A tamper-resistant ball bat, comprising:

a barrel having a tamper-resistant layer, the tamper-resistant layer including a plurality of composite strips layered such that each composite strip radiates outward from a longitudinal axis of the barrel, each composite strip having a plurality of longitudinal edges disposed at an angle with respect to the longitudinal axis of the barrel;

and a handle coupled to the barrel;

wherein each of the composite strips includes a plurality of fibers disposed at a different angle with respect to the longitudinal axis of the barrel than the angle of the fibers of one or more neighboring composite strips.

2. The tamper-resistant ball bat of claim 1, wherein the tamper-resistant layer includes between 36 and 72 composite strips.

3. The tamper-resistant ball bat of claim 1, wherein the angle at which the composite strips are disposed with respect to the longitudinal axis of the barrel is between about 5 degrees and about 20 degrees.

4. The tamper-resistant ball bat of claim 1, wherein the angle at which the fibers of each composite strip are disposed with respect to the longitudinal axis of the barrel is between about 25 degrees and about 50 degrees.

5. The tamper-resistant ball bat of claim 1,
further comprising a supplemental inner layer disposed beneath the tamper-resistant layer.

6. The tamper-resistant ball bat of claim 5,
wherein the supplemental inner layer includes a plurality of plies of graphite pre-preg.

7. The tamper-resistant ball bat of claim 1,
further comprising a supplemental outer layer disposed above the tamper-resistant layer.

8. The tamper-resistant ball bat of claim 7,
wherein the supplemental outer layer includes a plurality of plies of graphite pre-preg.

9. A tamper-resistant ball bat, comprising:
a barrel having a tamper-resistant layer, the tamper-resistant layer including a plurality of composite strips layered such that each composite strip radiates outward from a longitudinal axis of the barrel, each composite strip having a plurality of longitudinal edges disposed at an angle with respect to the longitudinal axis of the barrel;
and a handle coupled to the barrel;
wherein each composite strip includes a plurality of plies.

10. The tamper-resistant ball bat of claim 9,
wherein each ply includes a plurality of fibers disposed at a different angle with respect to the longitudinal axis of the barrel than the angle of the fibers of one or more plies in that particular composite strip.

11. A tamper-resistant ball bat, comprising:
a barrel having a tamper-resistant layer, the tamper-resistant layer including a plurality of composite strips layered such that each composite strip radiates outward from a longitudinal axis of the barrel, each composite strip having a plurality of longitudinal edges disposed at an angle with respect to the longitudinal axis of the barrel;
and a handle coupled to the barrel;
wherein the composite strips spiral around the barrel.

12. A tamper-resistant composite ball bat, comprising:
a barrel including a tamper-resistant layer, the tamper-resistant layer formed from a plurality of composite strips layered such that each composite strip radiates outward from a longitudinal axis of the barrel; and
a handle coupled to the barrel;
wherein the composite strips spiral around the barrel.

13. A method for manufacturing a tamper-resistant ball bat, the method comprising:
providing a plurality of composite strips, each composite strip having two longitudinal edges;
layering the composite strips such that the composite strips partially overlap one another with respect to the longitudinal edge of each composite strip;
rolling the layered composite strips onto a mandrel assembly such that the composite strips spiral around the mandrel assembly, and such that each composite strip radiates outward from a longitudinal axis of the mandrel assembly;
pressurizing the mandrel assembly;
curing the rolled layered composite strips; and removing the mandrel assembly.

14. The method of claim 13,
wherein the composite strips include varying lengths.

15. The method of claim 13,
wherein the plurality of composite strips includes a plurality of groups of composite strips, each composite strip having two latitudinal edges.

16. The method of claim 15,
further comprising layering the groups of composite strips such that the composite strips partially overlap one another with respect to the latitudinal edges of the composite strips in each group.

17. The method of claim 13,
wherein each composite strip includes a plurality of plies.

* * * * *